US008973470B1

(12) United States Patent
Coffland

(10) Patent No.: US 8,973,470 B1
(45) Date of Patent: Mar. 10, 2015

(54) WRAP-AROUND WRENCH HEAD

(71) Applicant: The Boeing Company, Seal Beach, CA (US)

(72) Inventor: Donald Wayne Coffland, Seattle, WA (US)

(73) Assignee: The Boeing Company, Chicago, IL (US)

( * ) Notice: Subject to any disclaimer, the term of this patent is extended or adjusted under 35 U.S.C. 154(b) by 245 days.

(21) Appl. No.: 13/631,066

(22) Filed: Sep. 28, 2012

(51) Int. Cl.
*B25B 13/00* (2006.01)
*B25B 13/46* (2006.01)

(52) U.S. Cl.
USPC ..... 81/90.1; 81/111

(58) Field of Classification Search
CPC ..... B25B 13/46; B25B 23/00
USPC ..... 81/90.1, 90.3, 90.5, 90.6, 90.8, 111, 81/112, 179
See application file for complete search history.

(56) References Cited

U.S. PATENT DOCUMENTS

| | | | | |
|---|---|---|---|---|
| 2,762,249 | A * | 9/1956 | Francisco | 81/90.1 |
| 7,886,636 | B1 * | 2/2011 | Mills | 81/179 |
| 8,250,948 | B1 | 8/2012 | Coffland | |
| 8,408,100 | B2 * | 4/2013 | Liu | 81/179 |
| 8,408,101 | B2 * | 4/2013 | Liu | 81/179 |
| 8,413,554 | B2 * | 4/2013 | Lee | 81/179 |
| 8,561,504 | B2 * | 10/2013 | Buchanan | 81/124.3 |
| 2010/0326245 | A1 * | 12/2010 | Lee | 81/58.2 |

OTHER PUBLICATIONS

Open-End Ratchet Wrenches; http://www.chicagobrand.com/Alden.com; retrieval date Jan. 18, 2012; 2 pages.

* cited by examiner

*Primary Examiner* — David B Thomas
(74) *Attorney, Agent, or Firm* — Armstrong Teasdale LLP

(57) ABSTRACT

A wrench head includes a first jaw member, a second jaw member, and a third jaw member. The first jaw member includes a first prong and a second prong. The second jaw member includes a third prong and a fourth prong. The second jaw member is pivotally coupled to the first jaw member at a first hinge. The third jaw member includes a fifth prong and a sixth prong. The third jaw member is pivotally coupled to the first jaw member at a second hinge.

19 Claims, 4 Drawing Sheets

WRAP-AROUND WRENCH HEAD

BACKGROUND

The present disclosure relates generally to hand tools and, more particularly, to a wrench head configured to engage a fastener.

Some known fasteners include at least one planar side that enables the fastener to be engaged by a hand tool, such as a wrench. However, if the wrench does not robustly engage the fastener, the wrench may undesirably round and/or slip off of the at least one planar side of the fastener. Depending on the pressure applied to the fastener, as the wrench slips off the fastener, at least some of the corners of the fastener may be prematurely worn. Worn fasteners are generally more difficult to engage than relatively new and/or unused fasteners, resulting in an acceleration of the wearing process.

To facilitate slowing the wearing process, at least some known wrenches (e.g., socket wrenches) engage the fastener on more than one side, reducing the changes that the wrench will slip off. Known socket wrenches, however, include a sidewall that requires vertical clearance above the fastener to approach and/or engage the fastener. Additionally, some fasteners (e.g., tube nuts) can deform or "ovalize" if the pressure is not applied uniformly around the periphery, which can affect the fastener tightening characteristics.

BRIEF SUMMARY

In one aspect, a method is provided for use in engaging a fastener using a wrench. The method includes positioning a first jaw member generally about the fastener. The first jaw member includes a first prong and a second prong. A second jaw member is positioned generally about the fastener. The second jaw member includes a third prong and a fourth prong. The second jaw member is pivotally coupled to the first jaw member at a first hinge. A third jaw member is positioned generally about the fastener. The third jaw member includes a fifth prong and a sixth prong. The third jaw member is pivotally coupled to the first jaw member at a second hinge.

In another aspect, a wrench head is provided. The wrench head includes a first jaw member including a first prong and a second prong. A second jaw member includes a third prong and a fourth prong. The second jaw member is pivotally coupled to the first jaw member at a first hinge. A third jaw member includes a fifth prong and a sixth prong. The third jaw member is pivotally coupled to the first jaw member at a second hinge.

In yet another aspect, a wrench head is provided. The wrench head includes a first jaw member including a first prong and a second prong. The first prong is configured to engage a side of a fastener, and the second prong is configured to engage a corner of the fastener. A second jaw member includes a third prong and a fourth prong. The second jaw member is pivotally coupled to the first jaw member at a first hinge.

The features, functions, and advantages described herein may be achieved independently in various embodiments of the present disclosure or may be combined in yet other embodiments, further details of which may be seen with reference to the following description and drawings.

Although specific features of various embodiments may be shown in some drawings and not in others, this is for convenience only. Any feature of any drawing may be referenced and/or claimed in combination with any feature of any other drawing.

DETAILED DESCRIPTION

The present disclosure relates generally to hand tools and, more particularly, to a wrench head configured to engage a fastener. In one embodiment, the wrench head includes a first jaw member, a second jaw member that are pivotally coupled to the first jaw member, and a third jaw member that are pivotally coupled to the first jaw member. When rotated in a clockwise direction about a right-handed threaded fastener, the wrench head is in an engaged configuration to induce torque to the fastener. When rotated in a counterclockwise direction about the fastener, the wrench head moves towards a disengaged configuration or "ratchets". The wrench head is "open" such that the wrench head may approach and/or engage the fastener from the side.

As used herein, an element or step recited in the singular and preceded with the word "a" or "an" should be understood as not excluding plural elements or steps unless such exclusion is explicitly recited. Moreover, references to "one embodiment" and/or the "exemplary embodiment" are not intended to be interpreted as excluding the existence of additional embodiments that also incorporate the recited features.

Figure 1:
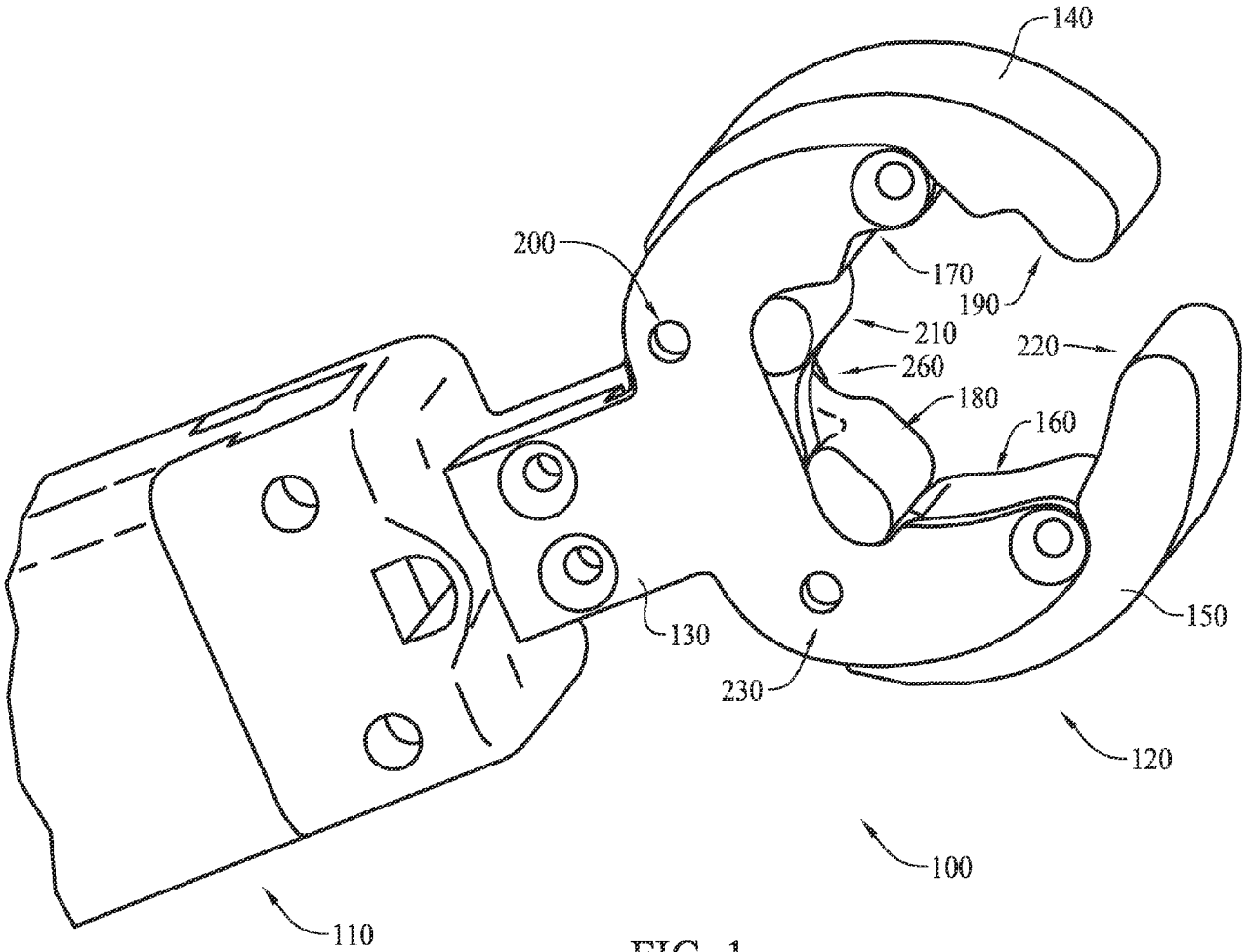
FIG. 1 is a perspective view of an exemplary wrench.

FIG. 1 is a perspective view of an exemplary wrench 100 including a handle 110 and a wrench head 120 that is coupled to handle 110. In the exemplary embodiment, wrench head 120 selectively tightens and/or loosens a fastener (shown in FIGS. 3 and 4) with a ratcheting motion that enables the fastener to be loosed and/or tightened without withdrawing wrench head 120 from the faster. In the exemplary embodiment, fasteners may include, without limitation, a nut, a screw, a bolt, and a bushing.

In the exemplary embodiment, wrench head 120 is configured to engage a six-sided fastener. More specifically, wrench head 120 includes a first jaw member 130 that are coupled to handle 110, a second jaw member 140 that are coupled to first jaw member 130, and a third jaw member 150 that are coupled to first jaw member 130. Alternatively, wrench head 120 may include any number of jaw members to engage any number of fastener sides.

In the exemplary embodiment, first jaw member 130 includes a first prong 160 and a second prong 170. In the exemplary embodiment, second jaw member 140 includes a third prong 180 and a fourth prong 190. In the exemplary embodiment, second jaw member 140 is pivotally coupled to first jaw member 130 at a first hinge 200 that is coupled between third prong 180 and fourth prong 190. More specifically, in the exemplary embodiment, first hinge 200 is a pin joint that enables second jaw member 140 to rotate about first hinge 200 between an engaged configuration (shown in FIG. 3) and a disengaged configuration (shown in FIG. 4). Alternatively, first hinge 200 may be any coupling mechanism located in any position that enables wrench 100 to function as described herein.

In the exemplary embodiment, third jaw member 150 includes a fifth prong 210 and a sixth prong 220. In the exemplary embodiment, third jaw member 150 are pivotally coupled to first jaw member 130 at a second hinge 230 that is coupled between fifth prong 210 and sixth prong 220. More specifically, in the exemplary embodiment, second hinge 230 is a pin joint that enables third jaw member 150 to rotate about second hinge 230 between an engaged configuration (shown in FIG. 3) and a disengaged configuration (shown in FIG. 4). Alternatively, second hinge 200 may be any coupling mechanism located in any position that enables wrench 100 to function as described herein.

Figure 2:
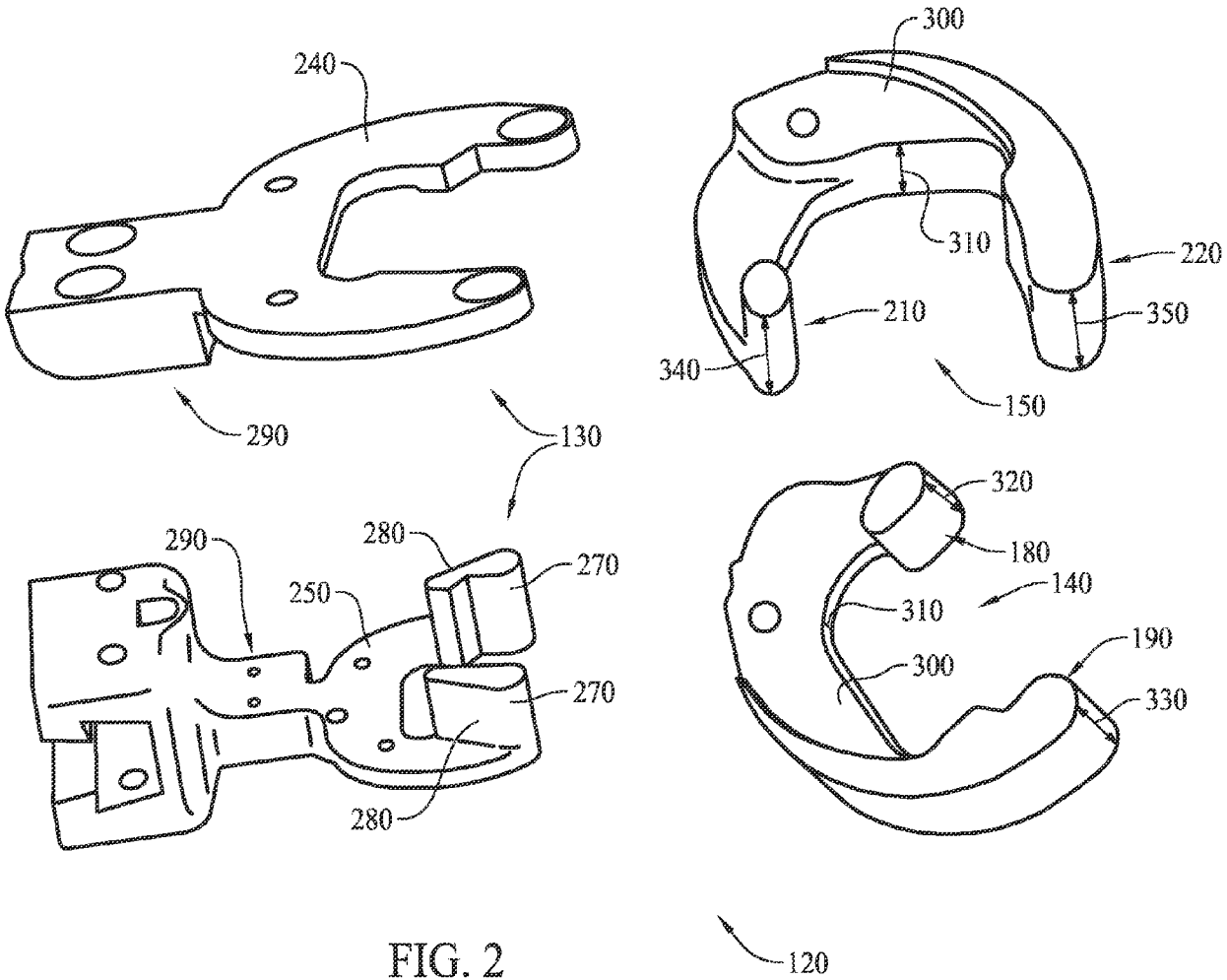
FIG. 2 is an exploded view of a wrench head that may be used with the wrench shown in FIG. 1.

FIG. 2 is an exploded view of wrench head 120. In the exemplary embodiment, first jaw member 130 includes a first portion 240 and a second portion 250 coupled to first portion 240 such that a slot 260 (shown in FIG. 1) is defined therebetween. In the exemplary embodiment, first portion 240 and/or second portion 250 include at least one flange 270 that extends generally towards the other portion (i.e., second portion 250 and/or first portion 240, respectively). In the exemplary embodiment, flange 270 includes at least one curved or contoured surface 280 that facilitates reducing friction generated between first jaw member 130 and second jaw member 140 and/or third jaw member 150.

Moreover, in the exemplary embodiment, first portion 240 and/or second portion 250 include at least one step 290 that extends generally towards the other portion (i.e., second portion 250 and/or first portion 240, respectively). Accordingly, in the exemplary embodiment, flange 270 and/or step 290 enables slot 260 to be defined between first portion 240 and second portion 250.

In the exemplary embodiment, second jaw member 140 and/or third jaw member 150 are sized and/or oriented to be positioned within slot 260. More specifically, in the exemplary embodiment, second jaw member 140 and/or third jaw member 150 each include a segment 300 positioned between third and fourth prongs 180, 190 and/or between fifth and sixth prongs 210, 220, respectively, that is sized and/or oriented to be positioned within slot 260. That is, a width 310 of segment 300 is narrower than a width 320 of third prong 180, a width 330 of fourth prong 190, a width 340 of fifth prong 210, and/or a width 350 of sixth prong 220. Moreover, in the exemplary embodiment, width 320, 330, 340, and/or 350 is wider than a width of slot 260 such that at least a portion of third prong 180, fourth prong 190, fifth prong 210, and/or sixth prong 220, respectively, is not sized and/or oriented to be positioned within slot 260. In the exemplary embodiment, width 320, 330, 340, and/or 350 have a predetermined thickness that enables robust contact with a fastener (not shown in FIG. 2) such that a substantially normal (i.e., 90 degrees) calibrated torque application may be maintained between wrench head 120 and the fastener.

Figure 3:
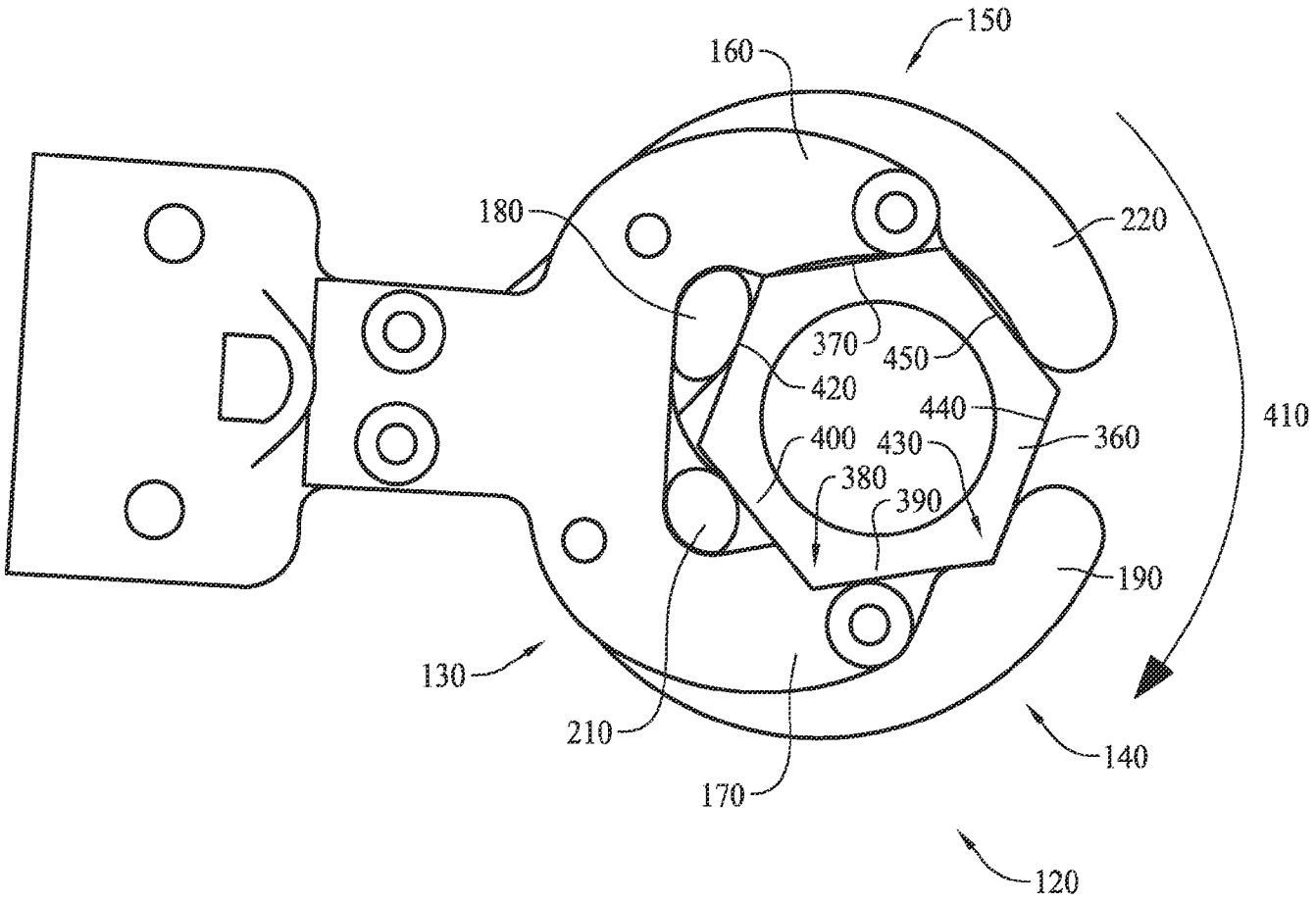
FIG. 3 is a side view of the wrench head shown in FIG. 2 in an engaged configuration with a fastener.
Figure 4:
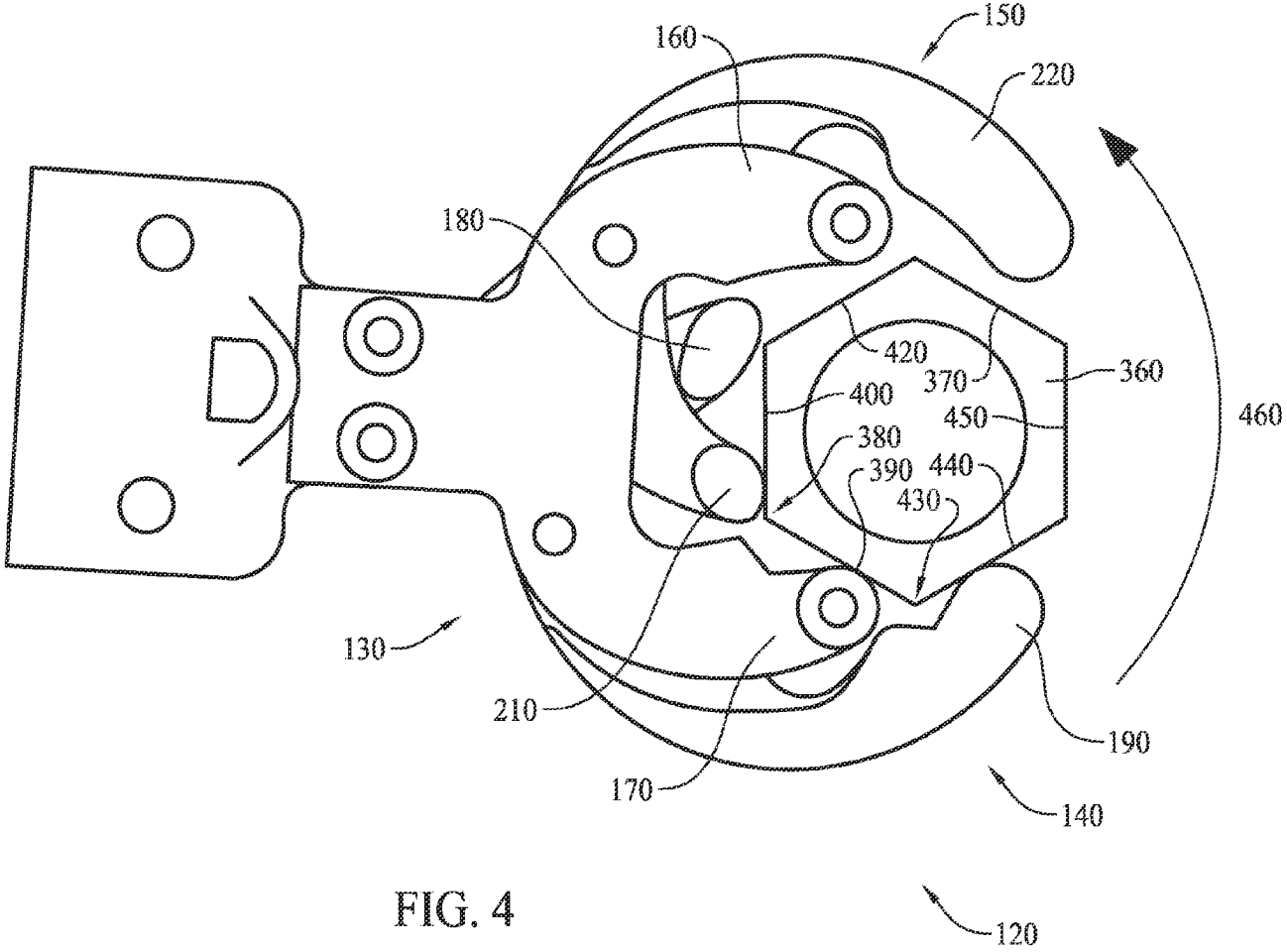
FIG. 4 is a side view of the wrench head shown in FIG. 2 in a disengaged configuration.

FIG. 3 is a side view of wrench head 120 in the engaged configuration. During operation, in the exemplary embodiment, wrench head 120 engages a fastener 360 from the side of fastener 360. After initially coupled to fastener 360, in the exemplary embodiment, first jaw member 130, second jaw member 140, and third jaw member 150 robustly engage fastener 360 to facilitate tightening fastener 360.

More specifically, in the exemplary embodiment, first prong 160 engages a first side 370 of fastener 360, and second prong 170 engages a first corner 380 of fastener 360. In the exemplary embodiment, corner 380 is at least partially defined by an opposing second side 390. Accordingly, in the exemplary embodiment, second prong 170 engages second side 390 and also an adjacent third side 400. In the exemplary embodiment, second prong 170 circumferentially trails first prong 160 as wrench head 120 is rotated in a clockwise or first direction 410.

Moreover, in the exemplary embodiment, third prong 180 engages a fourth side 420 of fastener 360, and fourth prong 190 engages a second corner 430 of fastener 360 at least partially defined by an opposing fifth side 440. Accordingly, in the exemplary embodiment, fourth prong 190 engages fifth side 440 and adjacent second side 390. In the exemplary embodiment, fourth prong 190 circumferentially trails third prong 180 when wrench head 120 is turned in first direction 410.

Furthermore, in the exemplary embodiment, fifth prong 210 engages third side 400 of fastener 360, and sixth prong 220 engages an opposing sixth side 450 of fastener 360. Accordingly, in the exemplary embodiment, all six sides 370, 390, 400, 420, 440, and 450 of fastener 360 (and, thus, all six corners) are simultaneously engaged by wrench head 120 when wrench head 120 is in the engaged configuration. Accordingly, in the exemplary embodiment, wrench head 120 generally maintains the engaged configuration as wrench head 120 is rotated in first direction 410.

Conversely, as wrench head 120 is rotated in a counterclockwise or second direction 460 (shown in FIG. 4), in the exemplary embodiment, wrench head 120 moves towards a disengaged configuration. In the exemplary embodiment, wrench head 120 is in the disengaged configuration when at least one side 370, 390, 400, 420, 440, and 450 of fastener 120 is not engaged by wrench head 120. In at least some embodiments, wrench head 120 includes a biasing mechanism (not shown) that biases wrench head 120 in the engaged configuration and/or the disengaged configuration.

When wrench head 120 is flipped "upside-down" (i.e., second prong 170 circumferentially trails first prong 160, and fourth prong 190 circumferentially trails third prong 180 when wrench head 120 is turned in second direction 460), wrench head 120 is in the engaged configuration and induces torque to fastener 120 when rotated in second direction 460, and moves towards a disengaged configuration or "ratchets" when rotated in first direction 410. Accordingly, in the exemplary embodiment, first jaw member 130, second jaw member 140, and third jaw member 150 robustly engage fastener 360 to facilitate loosening fastener 360 when wrench head 120 is flipped "upside-down".

The present disclosure relates generally to hand tools and, more particularly, to a wrench head that is configured to engage a fastener. The embodiments described herein enable a substantially normal force to be applied to each side of the fastener, thus reducing a likelihood of the wrench head slipping off of the fastener. Moreover, the embodiments described herein enable ratcheting to facilitate decreasing a chance of rotating the fastener in the wrong direction and/or decreasing a fastener installation time.

Exemplary embodiments of a wrap-around wrench head are described above in detail. The methods and systems are not limited to the specific embodiments described herein, but rather, components of systems and/or steps of the method may be utilized independently and separately from other components and/or steps described herein. Each method step and each component may also be used in combination with other method steps and/or components. Although specific features of various embodiments may be shown in some drawings and not in others, this is for convenience only. Any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method of engaging a fastener using a wrench, said method comprising:

positioning a first jaw member generally about the fastener, wherein the first jaw member includes a first prong and a second prong;

positioning a second jaw member generally about the fastener, wherein the second jaw member includes a third prong and a fourth prong, the second jaw member pivotally coupled to the first jaw member at a first hinge; and positioning a third jaw member generally about the fastener, wherein the third jaw member includes a fifth prong and a sixth prong, the third jaw member pivotally coupled to the first jaw member at a second hinge.

2. A method in accordance with claim 1, wherein positioning a first jaw member further comprises engaging a side of the fastener with the first prong, and engaging a corner of the fastener with the second prong.

3. A method in accordance with claim 1, wherein positioning a second jaw member further comprises engaging a side of a fastener with the third prong, and engaging a corner of the fastener with the fourth prong.

4. A method in accordance with claim 1, wherein positioning a third jaw member further comprises engaging a side of a fastener with the fifth prong, and engaging an opposing side of the fastener with the sixth prong.

5. A wrench head comprising:

a first jaw member comprising a first prong and a second prong;

a second jaw member comprising a third prong and a fourth prong, wherein the second jaw member is pivotally coupled to the first jaw member at a first hinge; and a third jaw member comprising a fifth prong and a sixth prong, wherein the third jaw member is pivotally coupled to the first jaw member at a second hinge.

6. A wrench head in accordance with claim 5, wherein the first jaw member comprises a first portion and a second portion coupled to the first portion such that a slot is defined therebetween.

7. A wrench head in accordance with claim 6, wherein at least one of the second jaw member and the third jaw member are positioned within the slot.

8. A wrench head in accordance with claim 6, wherein the first jaw member further comprises a flange extending substantially perpendicularly from at least one of the first portion and the second portion.

9. A wrench head in accordance with claim 5, wherein the first prong is configured to engage a side of a fastener, and the second prong is configured to engage a corner of the fastener.

10. A wrench head in accordance with claim 5, wherein the third prong is configured to engage a side of a fastener, and the fourth prong is configured to engage a corner of the fastener.

11. A wrench head in accordance with claim 5, wherein the fifth prong is configured to engage a side of a fastener, and the sixth prong is configured to engage an opposing side of the fastener.

12. A wrench head in accordance with claim 5, wherein the wrench head is configured to be in an engaged configuration when rotated in a first direction, and move towards a disengaged configuration when rotated in a second direction.

13. A wrench head in accordance with claim 5, wherein a width of at least one of the first prong, the second prong, the third prong, the fourth prong, the fifth prong, and the sixth prong has a thickness that enables robust contact with a fastener such that a substantially normal torque application may be maintained between the wrench head and the fastener.

14. A wrench head comprising:

a first jaw member comprising a first prong and a second prong, wherein the first prong is configured to engage a side of a fastener, and the second prong is configured to engage a corner of the fastener;

a second jaw member comprising a third prong and a fourth prong, wherein the second jaw member is pivotally coupled to the first jaw member at a first hinge; and a third jaw member comprising a fifth prong and a sixth prong, wherein the third jaw member is pivotally coupled to the first jaw member at a second hinge.

15. A wrench in accordance with claim 14, wherein the first jaw member comprises a first portion and a second portion coupled to the first portion such that a slot is defined therebetween, the second jaw member positioned within the slot.

16. A wrench head in accordance with claim 14, wherein the third prong is configured to engage a side of a fastener, and the fourth prong is configured to engage a corner of the fastener.

17. A wrench head in accordance with claim 14, wherein the fifth prong is configured to engage a side of a fastener, and the sixth prong is configured to engage an opposing side of the fastener.

18. A wrench head in accordance with claim 14, wherein the wrench head is configured to be in an engaged configuration when rotated in a first direction, and move towards a disengaged configuration when rotated in a second direction.

19. A wrench head in accordance with claim 14, wherein a width of at least one of the first prong, the second prong, the third prong, and the fourth prong has a thickness that enables robust contact with the fastener such that a substantially normal torque application may be maintained between the wrench head and the fastener.

* * * * *